US006672431B2

(12) United States Patent
Brand et al.

(10) Patent No.: US 6,672,431 B2
(45) Date of Patent: Jan. 6, 2004

(54) METHOD AND SYSTEM FOR CONTROLLING AN ELEVATOR SYSTEM

(75) Inventors: Matthew E. Brand, Newton, MA (US); Daniel N. Nikovski, Somerville, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 0 days.

(21) Appl. No.: 10/161,304

(22) Filed: Jun. 3, 2002

(65) Prior Publication Data

US 2003/0221915 A1 Dec. 4, 2003

(51) Int. Cl.[7] ..... B66B 1/18
(52) U.S. Cl. ..... 187/382; 187/247
(58) Field of Search ..... 187/382, 380, 187/247, 381, 384, 392; 706/910, 13

(56) References Cited

U.S. PATENT DOCUMENTS 4,591,985 A * 5/1986 Tsuji ..... 187/392
5,031,728 A * 7/1991 Amano ..... 187/382
5,354,957 A * 10/1994 Robertson ..... 187/247
5,612,519 A * 3/1997 Chenais ..... 187/382
5,679,932 A * 10/1997 Kim ..... 187/382
6,000,504 A * 12/1999 Koh et al. ..... 187/382
6,145,631 A 11/2000 Hikita et al. ..... 187/383
6,325,178 B2 * 12/2001 Hikita et al. ..... 187/382
6,345,697 B1 2/2002 Siikonen ..... 187/382
6,439,349 B1 * 8/2002 Smith ..... 187/382

OTHER PUBLICATIONS

R. Crites and A. Barto, "*Improving Elevator Performance using Reinforcement Learning*," in Touretzky et al. Ed., MIT Press, "*Advances in Neural Information Processing Systems*," vol. 8, pp. 1017–1023, 1996.

* cited by examiner

*Primary Examiner*—Jonathan Salata
(74) *Attorney, Agent, or Firm*—Andrew Curtin; Dirk Brinkman

(57) ABSTRACT

A method controls an elevator system including multiple elevator cars and multiple floors. A new passenger at one of the floors signals a hall call. In response to receiving the hall call, the method determines, for each car, a set of all possible future states of the elevator system. The future states depend on the current state of the system, which is defined by passengers already assigned to cars, the direction of travel, position and velocity of the cars. A cost function is evaluated to determine a cost for each set of all possible future states. Then, the car associated with the set having a least cost is assigned to service the hall call. The method is applicable to any type of traffic. It is particularly well-suited for up-peak traffic because it handles efficiently the uncertainty in passenger destinations.

16 Claims, 6 Drawing Sheets

```
BUILDTRELLIS
S[1, v_1, p_1].flag := TRUE
for i := 1 to H do
  for v := N_v − 1 to 0 do
    for p := N_h to 0 do
      if S[i, v, p].flag then
        if v = 0 and i < H then
          if canreverse[i] and p = 0 then
            i' := rev[i]
            v' := 0
            p' := h[i']
          else
            i' := i + 1
            v' := 1
            p' := p
          end if
          S[i', v', p'].flag := TRUE
          P[i, v, p, i', v', p'] := 1
          C[i, v, p, i', v', p'] := c[i']T[i, v, p, i', v', p']
        else
          for x := 0 to p do
            if x > 0 or carcall[i] or hallcall[i] or lastfloor[i] or (p = 0 and canreverse[i]) then
              i' := i
              v' := 0
              p' := p − x + h[i]
            else
              i' := i + 1
              if v < N_v − 1 then
                v' := v + 1
              else
                v' := v
              end if
              p' := p
            end if
            if i' ≤ H then
              S[i', v', p'].flag := TRUE
              P[i, v, p, i', v', p'] := Pr(x, p, g[i])
              C[i, v, p, i', v', p'] := c[i']T[i, v, p, i', v', p']
            end if
          end for
        end if
      end if
    end for
  end for
end for
```

*Fig. 4*

EVALUATETRELLIS

```
for i := H to 1 do
    for v := 0 to N_v − 1 do
        for p := 0 to N_h do
            S[i, v, p].costtogo := 0
            if S[i, v, p].flag then
                for all S[i', v', p'] successors to S[i, v, p] do
                    S[i, v, p].costtogo := S[i, v, p].costtogo + P[i, v, p, i', v', p'](C[i, v, p, i', v', p'] +
                    S[i', v', p'].costtogo)
                end for
            end if
        end for
    end for
end for
return S[i, v_1, p_1].costtogo
```

*Fig. 5*

METHOD AND SYSTEM FOR CONTROLLING AN ELEVATOR SYSTEM

FIELD OF THE INVENTION

The invention relates generally to elevator group control, and more particularly to optimizing group elevator scheduling. BACKGROUND OF THE INVENTION Group elevator scheduling is a well-known problem in industrial control and operations research with significant practical implications, Bao et al., "Elevator dispatchers for down-peak traffic," Technical Report, University of Massachusetts, Department of Electrical and Computer Engineering, Amherst, Mass., 1994. Given a hall call generated at one of the floors of a building with multiple elevator shafts, the objective of elevator group control is to decide which car to use to serve the hall call.

In some elevator systems, the controller assigns a car to the hall call as soon as the call is signaled, and immediately directs the passenger who signaled the hall call to the corresponding shaft by sounding a chime. While in other systems, the chime is sounded when the assigned car arrives at the floor of the hall call.

That difference influences car assignment in two ways. Making an early assignment to service the hall call impairs the performance of the controller when the assignment is incorrect. That makes the assignment problem harder because the controller has to consider events over a longer time interval. Also, after a decision is made, the decision cannot be changed.

Scheduling policy is subject to constraints arising from passenger expectations, destinations, and elevator movement. The constraints can include passengers arrival rates on all floors, fixed or variable inter-floor travel times, and fixed passenger destinations and/or origins, etc.

While one objective of elevator control is to minimize the cost of operating the system, e.g., the cost measured in terms of waiting and/or travel times of passengers in all types of traffic, several traffic patterns are of special interest because those patterns pose extraordinary demand on the elevator group and its controller. Such traffic patterns are up-peak traffic, which arises at the beginning of the workday in an office building, down-peak traffic, which arises at the end of the workday, and lunch traffic, down first, and up a little later.

Up-peak traffic is characterized by a large number of passengers arriving in the lobby, boarding cars and exiting the cars at the upper floors while, simultaneously, a lesser number of passengers travel between floors other than the lobby. Such a traffic pattern has uncertainty in the destination floors of passengers, while the floor of the car call is most frequently the lobby.

The reverse situation is down-peak traffic, when most passengers board cars at one of the upper floors and exit the car at the lobby, while a lesser number of passengers travel to destinations other than the lobby. Correspondingly, the amount of uncertainty in the case of down-peak traffic is opposite to that of up-peak traffic because there is little uncertainty about the destination floor, i.e., the lobby, but there is greater uncertainty in the call floor.

Lunch traffic combines elements of down-peak and up-peak traffic. The system starts with down-peak traffic and then slowly shifts to up-peak traffic. In addition to having uncertainty in both call and destination floors, the properties of passenger flow shift with time.

Elevator scheduling could be expressed as combinatorial optimization problems. Solutions to these problems are characterized by identifying an optimum solution for transitioning from a current state to a desired state, where the desired state is selected from all possible future states. In principle, combinatorial optimization problems could be solved by evaluating all possible combinations of choices and selecting only that combination that gives the most favorable result.

However, other than for simple problems, the number of possible choices increases exponentially and rapidly becomes so large that, even when digital computers are employed, the solution of a single problem on a single processor may take hours, days, sometimes even months or years, see below. Up to now, prior art elevator scheduling systems and methods have not considered evaluating all possible solutions to find a best solution. Typically, only a subset of solutions are considered, or the operation of the elevators is severely in constrained in some way to make the problem solvable in real-time.

For example, partial solutions have been obtained for the limited case of purely up-peak traffic, and the constraints that all passengers arrive in the lobby at a fixed rate and no other call floors are allowed, see, e.g., Pepyne et al., "Optimal dispatching control for elevator systems during up peak traffic," IEEE transactions on control systems technology, 5(6):629–643, 1997. In order to make the problem manageable, the service time of elevators is assumed to come from a fixed exponential distribution.

Many prior art controllers used the principle of collective control, see Strakosch et al., "Vertical transportation: elevators and escalators," John Wiley & Sons, Inc., New York, N.Y., 1983. With collective control, cars are constrained to always stop at the nearest call in their running direction. That strategy ignores the total state of the system and usually results in bunching. Bunching is a phenomenon where several cars arrive at the same floor at about the same time, with all cars but one wasting time, see Hikihara et al., "Emergent synchronization in multi-elevator system and dispatching control," IEICE Transactions on Fundamentals of Electronics, Communications and Computer Sciences, E80-A(9):1548–1553, 1997. They concluded that the bunching effect occurring in down-peak traffic was due to synchronization between multiple cars.

Another prior art approach constrains operation by zoning, or sectoring. There, the building is divided into zones and each car is assigned a single zone. While that approach avoids bunching, it also ignores the total state of the system.

Other control techniques and heuristics can also be used. Mitsubishi Electric's elevator group control system, "AI-2100N," is based on an expert system with fuzzy rules. That system relies on expert judgment of humans to prescribe a good assignment of calls. That system cannot determine a solution to a scheduling problem by itself. Rather, that system identifies the problem and employs preprogrammed human derived solutions to the problem, see Ujihara et al., "The revolutionary AI-2000 elevator group-control system and the new intelligent option series," Mitsubishi Electric Advance, 45:5–8, 1988, and Ujihara et al., "The latest elevator group-control system," Mitsubishi Electric Advance, 67:10–12, 1994.

The Otis elevator Relative System Response (RSR) method and its variants estimate, for each car, the time it would take to service the already assigned calls when a new call arises, and assigns the car with the lowest remaining service time to that call. The RSR methods are examples of greedy methods They either are constrained to have a predetermined assignment of calls, or never reconsider an assignment.

A more sophisticated group of methods use non-greedy strategies which recompute car assignments after each change of state. As noted, such methods are not applicable to certain elevator groups where reassignments are not allowed. Examples of such methods are Finite Intervisit Minimization (FIM) and Empty the System Algorithm (ESA), see Bao et al. While they have been demonstrated to outperform simpler methods by a margin of 34%, FIM and ESA are limited to down-peak traffic because they presume that the destination of all passengers is constrained to be the lobby. That method is not optimal in real world elevator systems where the lobby is certainly not the only desired destination.

Furthermore, such methods are constrained to assume no new passenger arrivals occur while a call is processed, and find the best strategy to service the existing calls given that simplification. Thus, by failing to take into account the stochastic component of the elevator system, a significant number of potential future states of the system are totally ignored. A method that could take into account the stochastic component of elevator group behavior has a potential to outperform those methods.

One such method uses neural networks and Q-learning to provide an asynchronous method for stochastic optimal control, see Crites et al., "Improving elevator performance using reinforcement learning," Touretzky et al. Ed., MIT Press, "Advances in Neural Information Processing Systems, volume 8, pages 1017–1023, 1996. Although their method performed slightly better than FIM and ESA for one specific down-peak profile, it took 60000 hours (over seven years) of simulated elevator operation to converge. Obviously, this is not practical for real-time elevator control. One possible reason for its slow convergence is the generally inefficient use of training samples by Q-learning. Q-learning discards training samples as soon as it makes a small adjustment in the parameters controlling the current scheduling policy.

Therefore, what is needed is a method for elevator control which determines every possible choice and selects a car to answer a hall call that minimizes passenger waiting time in all types of passenger flow situations.

SUMMARY OF THE INVENTION

The invention provides a method for controlling an elevator system including multiple elevator cars and floors. A new waiting passenger at one of the floors places a hall call. The hall call is received and an expected cost for servicing each waiting passenger including the new waiting passenger is estimated. The elevator car that minimizes the total cost for servicing all of the waiting passengers is selected to respond to the hall call.

More particularly, in response to receiving the hall call, the method determines, for each car, all possible future states of the elevator system. The states are dependent on discrete and continuous variables. The continuous variables are discretized. Both the discrete and discretized variables are applied to a trellis structure corresponding to a number of all possible future states of the system. A path across the trellis structure is evaluated according to transitional probabilities of transitioning between states for each car in the system. The car with a minimum cost according to an estimated path across the trellis is selected to serve the hall call. The method is applicable to any type of traffic. It is particularly well-suited for up-peak traffic because it handles efficiently the uncertainty in passenger destinations.

BRIEF DESCRIPTION OF THE DRAWINGS

FIG. 4 is pseudo-code of a procedure for constructing the trellis of FIG. 3; and FIG. 5 is pseudo-code of a procedure for evaluating the trellis of FIG. 3.

DETAILED DESCRIPTION OF THE PREFERRED EMBODIMENT

System Overview

Figure 1:
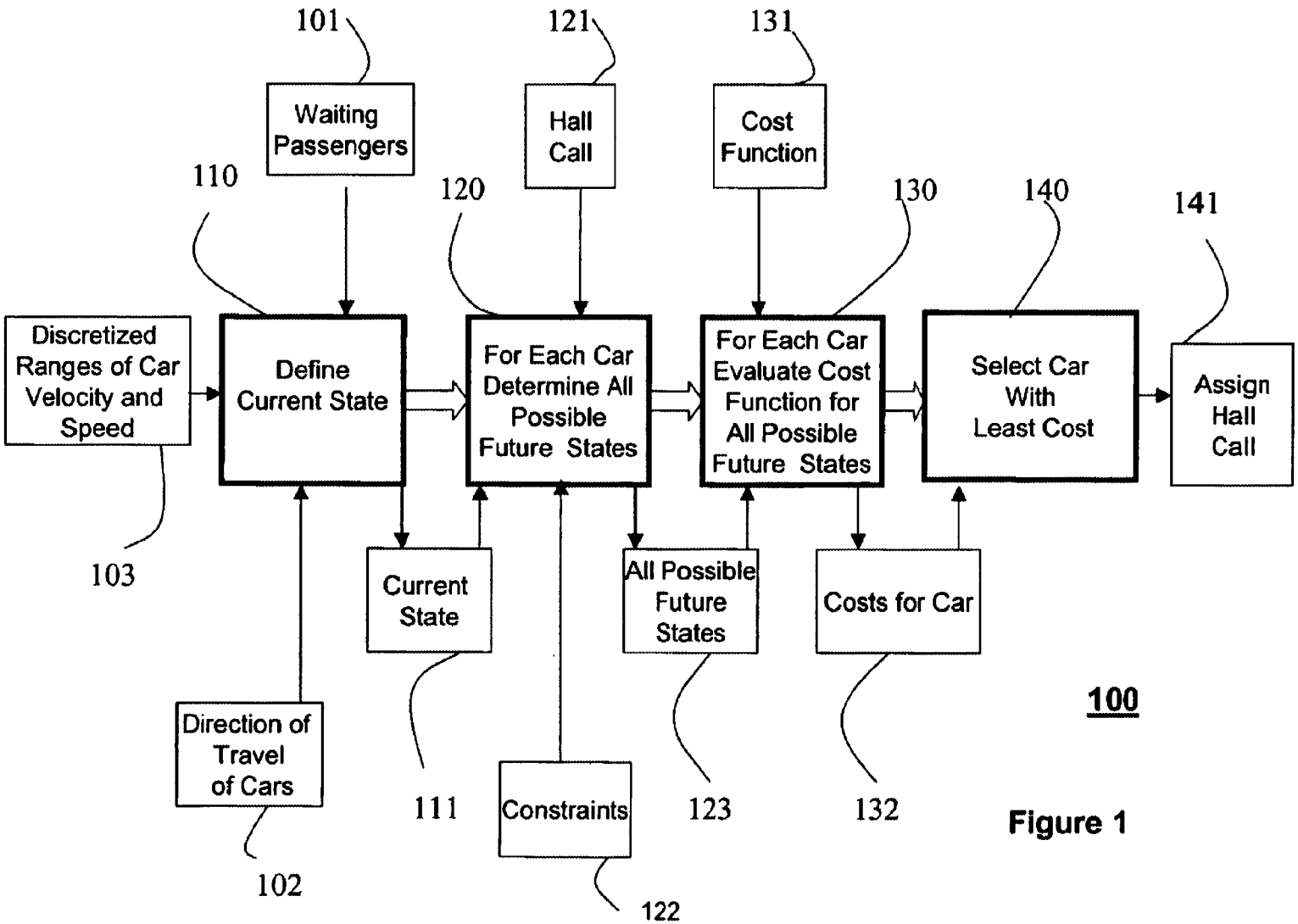
FIG. 1 is a block diagram of an elevator control method and system according to the invention.
Figure 6:
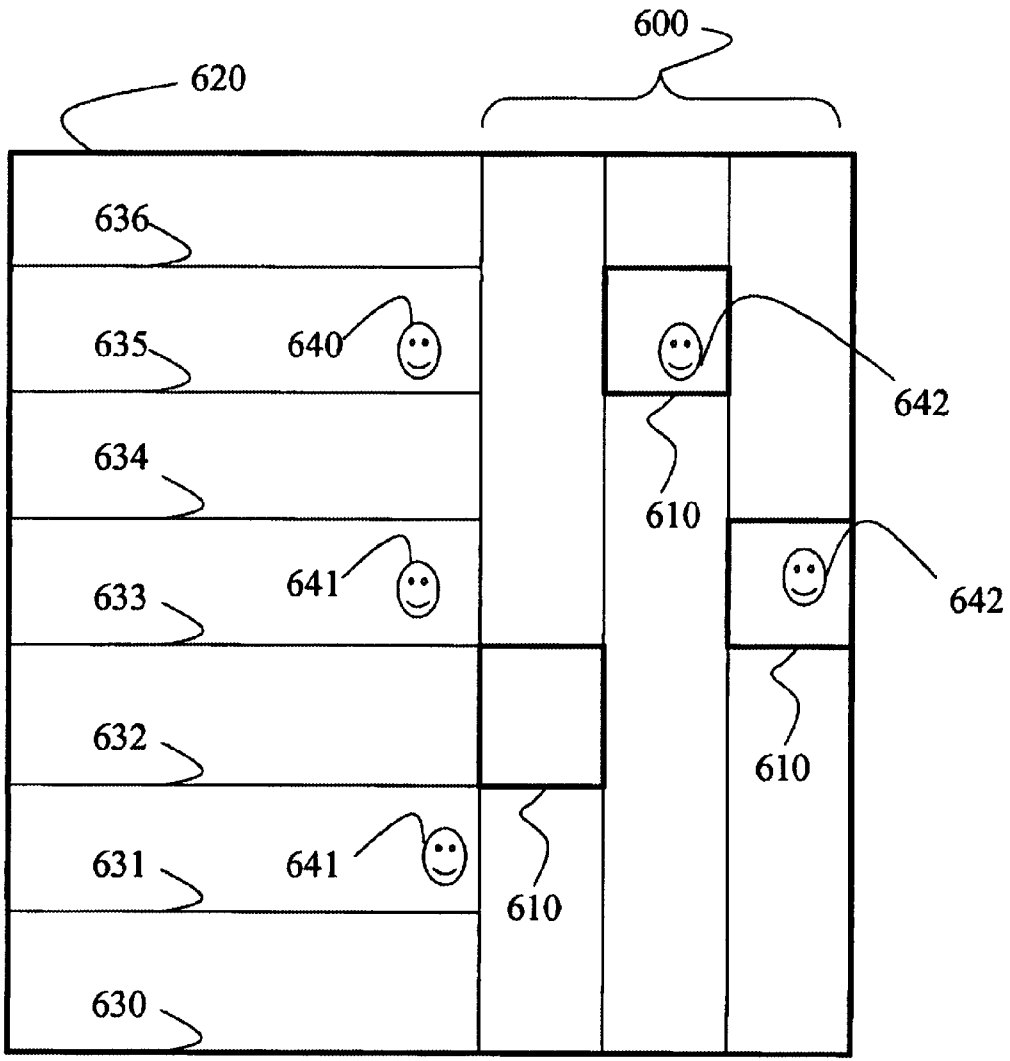
FIG. 6 shows an example of an elevator system that can use the invention.

FIG. 1 shows a method and system 100 for controlling an elevator system, for example, system 600, see FIG. 6, according to the invention. The system controls elevator cars 610, see FIG. 6, for a building 620, see FIG. 6, with multiple floors 630–636, see FIG. 6. A current state 111 of the elevator system is defined 110 using parameters 101–103. Knowing the current state, future states can be determined. Upon receipt of a hall call 121, the system determines 120, for each car, all possible future states 123 to service the hall call, considering existing constraints 122. For each car, a cost function 131 is evaluated 130 to determine a cost 132 for all possible future states to assign the a car to the hall call 121. The car that has the least cost is selected 140, and that car is then assigned 141 to service the hall call 121.

In the system according to the invention, three types of passengers are defined, namely: new 640, waiting 641, and riding 642 passengers, see FIG. 6.

A new passenger has signaled a hall call, either "up" or "down," but has not yet been assigned to a car. Therefore, for the purpose of this invention, a new passenger is synonymous with an unassigned hall call. Hall calls have cars assigned to them in the order they are signaled, that is, one at the time.

Waiting passengers have cars assigned to their hall call, but have not yet indicated their destination floor. Therefore, for the purpose of this invention, waiting passengers are synonymous with assigned cars. The servicing of waiting passengers depends on the direction of travel of the cars. Servicing means having a car stop at the floor of the hall call, and the waiting passenger boarding the assigned car to become a riding passenger.

Riding passengers are in an assigned car, and have indicated their destination floor upon boarding. Therefore, for the purpose of this invention, riding passengers are synonymous with serviced hall calls.

Call Types

In the system according to the invention, two types of calls are defined, namely: hall and car calls.

A hall call is signaled by a new passenger. A hall call only indicates a desired direction of travel.

A car call is signaled by a waiting passenger upon boarding a car, and selecting a desired floor, at which point the waiting passenger becomes a riding passenger.

Discrete and Continuous Variables

At any time, the states of the elevator system are defined by discrete and continuous variables. Included among the discrete variable are the waiting passengers (assigned cars to hall calls) 101, which can be the null set, i.e., there are no waiting passengers. Waiting passengers have already been assigned to the various cars. Another discrete variable defining the state of the system is the direction of travel of a car 102, i.e., "up" or "down."

Continuous variables, such a current position of a car and the car's velocity, are converted to ranges of discrete variables 103 to make the defining 110 manageable. When the hall call 121 is received at one of the floors, costs 132 for servicing the set of waiting passengers 101 and the hall call 121 are determined for each car, considering existing constraints 122, such as the riding passengers. Riding passengers are those passengers who have already boarded an assigned car and have indicated their desired destination floors. That is, known destinations floors at which the cars will stop in the future. The set of riding passengers can also be a null set. The car associated with the least cost to service the new passenger and the set of waiting passengers is then selected 140 and assigned 141 to service the hall call.

For example, when the hall call for a particular direction is signaled by the new passenger at a particular floor, the system receives the hall call. A car has already been assigned to each passenger in the set of waiting passengers and, according to our method, their assignments is never reconsidered. For each car, the cost, e.g., the total residual waiting time of all of the waiting passengers and the new passenger or energy cost, is estimated. The car with the least cost is then assigned to the new call.

Optimization Criterion

If the elevator group has a total of $N_c$ cars, then the cost for servicing the waiting passengers with assigned cars i is denoted by $C_i^-$, for i=1, . . . , $N_c$, i.e., this cost does not include the cost for assigning a car to the new passenger. According to the method of the invention, the assignments of cars to waiting passengers (assigned hall calls) is not reconsidered.

If the hall call is signaled, then the total cost for servicing the waiting passengers by assigned cars i and the new passenger is denoted by $C_i^+$, for i=1, . . . , $N_c$. (s). We can then determine the cost $C_i$ associated with assigning any car i to the new passenger as $$C_i = C_i^+ + \sum_{j=1, i\neq j}^{N_c} C_j^-, \quad \text{for } i = 1, \ldots, N_c.$$

A particular car c selected for assignment to the new passenger (hall call) is the one which minimizes the total residual cost $c=\text{argmin}_i C_i$. Because the set of waiting passengers is constant at the time of a particular decision step or state transition, such an assignment also minimize the average expected cost, which is determined as the total residual cost of all passengers divided by the number of passengers in the set for the car under consideration.

If $$C^- = \sum_{i=1}^{N_c} C_i^-,$$

then the expected cost for each possible assignment can be expressed as $C_i=C_i^+-C_i^-+C^-$, for i=1 to $N_c$, and because $C^-$ is the same for each i, the assignment which minimizes $\Delta C_i=C_i^+-C_i^-$ is also the assignment that minimizes $C_i$. In other words, the car assignment, which minimizes the expected average expected cost, is the assignment for which the marginal increase in cost is minimal. As a result, the optimal assignment can be found by determining $C_i^+$ and $C_i^-$ for each car, and selecting the car for which their respective cost difference is minimal, or the least.

Determining $C_i^+$ and $C_i^-$ for a particular car i is essentially the same problem. The only difference between the two cases is that for the determination of $C_i^+$, car i is considered to be already assigned to the new passenger, while for determining $C_i^-$, the new passenger is ignored.

Hence, determining both $C_i^+$ and $C_i^-$ can be done by the same procedure, which takes as inputs the current position, direction, velocity, and passengers inside car i, the floor and direction of pressed car buttons, and the floor, direction, and number of waiting passengers at each floor to be served by that car. For notational simplicity, henceforth, we denote the result returned by this procedure as the expected cost C, which, as noted, can mean either $C_i^+$ or $C_i^-$ for the car i being considered currently.

By definition, C is the expected total expected cost for the set of waiting passengers, subject to the constraints imposed by the current position, direction and velocity of a car, as well as the currently signaled car calls mandating stops at requested floors. The expectation of the cost is taken with respect to the uncertainty in the destinations of passengers yet to be serviced by the car. Because only the requested direction of travel is known, the destination of the new passenger can be any of the remaining floors in that direction.

Dynamic Programming

Dynamic programming is commonly employed in stochastic control where cost estimates on segments of a system path can be reused in multiple paths, see Bertsekas, "*Dynamic Programming and Optimal Control*," Volumes 1 and 2, Athena Scientific, Belmont, Mass., 2000. Successfully solving problems by means of dynamic programming involves identification of branching points where system paths converge and then diverge again. We determine the costs on a segment between two such points only once, and then reuse the costs for the determination of costs along all paths which include the segment. Thus, the optimization problem for considering all possible future states does not grow exponentially, and an optimal solution can be found in real-time.

Figure 2:
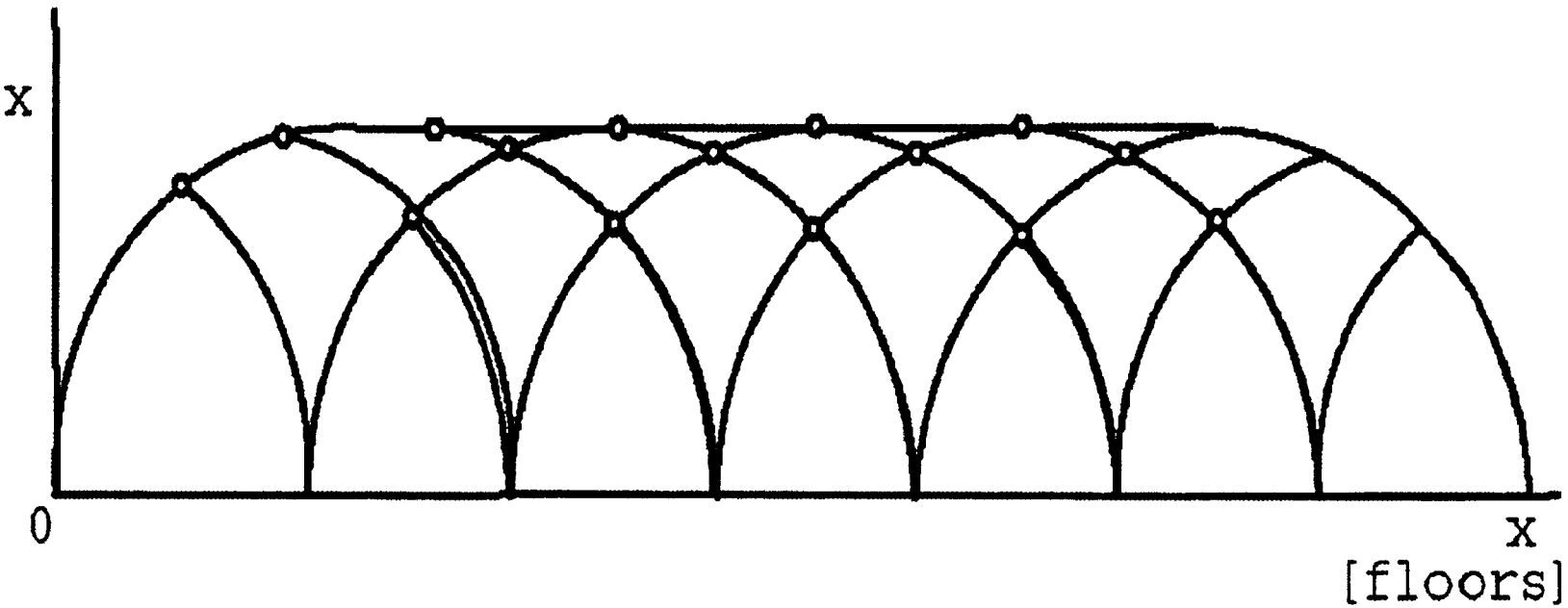
FIG. 2 is a phase-space diagram of a single elevator car moving upwards in a shaft of a building with eight floors.

As shown in FIG. 2, such branching points can be identified on a phase-space diagram 200 of an elevator car. Like any moving mechanical system, a car traveling in an elevator shaft can be modeled with the phase-space diagram, which describes the possible coordinates $(x, \dot{x})$ for the position of the car along the shaft x and its velocity $\dot{x}$. When the car is moving under constant acceleration without friction, its trajectory includes segments which are parts of parabolas. These trajectories branch only on a small number of points, denoted by circles in FIG. 2. These points always correspond to the last possible location at which a car can still stop at one of the floors in its direction of motion. A particular path of a car includes a finite number of segments, whose endpoints are branching or resting points. Consequently, if the expected cost on each such segment can be determined, then that cost can be reused for the determination along any paths which include that segment.

Reusing the costs on all individual segments can be achieved by embedding a discrete Markov chain into the original system of elevator movement which operates in continuous time and space.

Discrete and Discretized States of the Markov Chain

Formally, a Markov chain includes a finite number of states $S_i$, i=1, . . . , N, an immediate cost $C_{ij}$ of the transition between each pair of states $S_i$ and $S_j$, a matrix $P_{ij}$ of the probabilities of transition between states $S_i$ and $S_j$, and a distribution $\pi(S_i)$, which specifies the probability that the system is in any state $S_i$.

In order for the chain to be Markovian, it obeys the well known Markov property that the probability $P_{ij}$ of transitioning to a next possible future state $S_j$ depends only on the current state $S_i$, and not on the trajectory of the system before it entered the current state $S_i$. If we determine all possible future states of the system to correspond only to the branching points in the phase-space diagram, then the resulting chain is not Markovian, because the probability of branching depends on the number of riding passengers, and that number depends on how many of the riding passengers have already been transported to their destinations at previous stops of the car.

Consequently, the number of waiting passengers has to be included in the current state of the Markov chain so that it can obey the Markov property. This number does not include the riding passengers who have signaled their destinations by pressing car buttons. However, the riding passengers influence the motion of the car too. They impose constraints on its motion in the form of obligatory car stops. These constraints 122 are deterministic and have no impact on branching probabilities, which depend only on the uncertainty in the destinations of the set of waiting passengers who are yet to board cars and select floors.

The state $S_i$ of the Markov chain is described by the four-tuple (f, d, v, n), where f is the position of the car, d is its direction, v is its velocity, and n is the number of riding passengers. As stated above, the variables d and n are discrete, and have predefined ranges, e.g., d can take only two values, "up" and "down." The number of passengers n ranges from 0 to the maximum number of passengers assigned to a car and traveling in either direction. The maximum number is reached, for example, when all riding passengers decide to get off the car at the last floor in the current direction of motion. At that point, all possible future states have been explored.

The variables f and v, however, are essentially continuous. In order to make the problem tractable, these variables are discretized. An inspection of the phase-space diagram 200 of FIG. 2 suggests a discretization scheme for the velocity v. It can be seen that while accelerating after having stopped at a particular floor, the car reaches branching points along its trajectory only at a small number of velocities, including the quiescent state, when the velocity is zero. The reason for this is the limit on the maximum velocity of any elevator car.

Depending on the inter-floor distance, maximum velocity and acceleration of cars, the number of distinct velocities at branching points can be lower, e.g., for longer inter-floor distances, lower maximum velocity, and greater acceleration, respectively. The inverse is also true, e.g., for shorter inter-floor distances, higher maximum velocity, and lower acceleration. For a particular elevator bank, this number of distinct velocities is fixed and can be found easily. Henceforth, we assume it is known and denote it by $N_v$. Hence, the variable v takes only $N_v$ discrete values, ranging from 0 at rest to $N_v$–1 at maximum velocity. Note that the same value of v can correspond to different physical velocities, depending on the last floor where the car stopped. Another interpretation of this variable is the number of branching points a car has encountering since its last stop.

There are several ways to discretize the position variable f. A preferred discretization scheme selects for the value of f the floor at which the car will stop when it starts decelerating at that branching point. The advantage of such a discretization scheme becomes apparent when we organize the states of the Markov chain in a regular structure called a trellis in dynamic programming. The trellis can be constructed in a memory as a data structure described below.

Trellis Structure and Parameters of the Embedded Markov Chain

Figure 3:
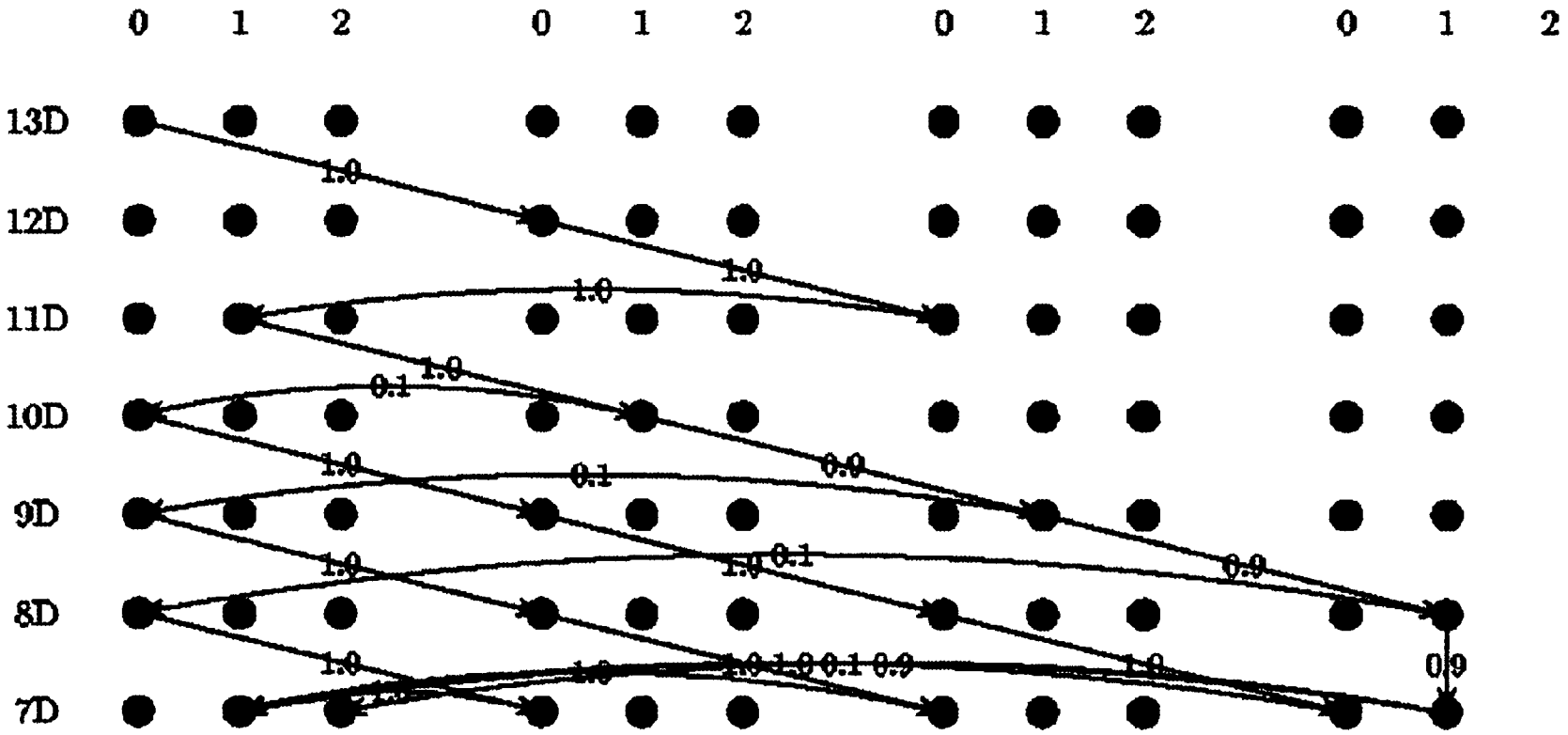
FIG. 3 is a diagram of a trellis structure according to the invention.

FIG. 3 shows a dynamic programming trellis 300 for a Markov chain for a very simple problem of a single moving car. The car is moving down (D), and is about to reach a branching point to stop at floor 13, if the car decelerates. The car has already been scheduled to pick up a waiting passenger at floor 7, and the controller is considering whether this car should also respond to a "down" new hall call, signaled at floor 11.

To illustrate the complexity of problem, the embedded Markov chain, for only a single car with at most two riding passengers over a range of only six floors, already has 84 possible states. Obviously, in a real system operating at peak time with dozens of elevators, a large number of floors, full cars, and many new and waiting passengers, the number of possible future states is extremely large. In fact, the number of possible future states is so large that all possible solutions can not be considered, in real-time, by prior art systems.

The states are placed in a trellis matrix of 7 rows and 12 columns. The placement of states is such that all states for which the car stops at the same floor, when it starts decelerating at the corresponding branching points, are placed in the same row. Note that this applies to branching points reached when the car is moving in a particular direction. When the car is moving in the opposite direction, the branching points generally have different positions on the phase space diagram.

The corresponding row of the trellis is labeled with the floor at which the car can possibly stop, as well as the direction of the movement of the car, when the car reaches the branching points. Because there is a separate row for each direction, the trellis has at most $2N_f$ rows.

Furthermore, the states in each row of the trellis are organized in $N_v$ groups, for example, four. The groups correspond to the $N_v$ possible velocity values at branching points ordered so that the leftmost column correspond to zero velocity, and the rightmost column correspond to the maximum velocity of the car. Within a group, the states correspond to the number of riding passengers, e.g., ranging from 0 to 2.

This organization of states constitutes the trellis of the dynamic programming problem. Not all of the states in the trellis can be visited by the car because its motion is constrained by the current hall call, and the waiting and riding passengers. These then are impossible future states. Therefore, we only consider possible future states.

If the floor-value component f of the four-tuple used to describe a branching point is that of the floor where the car will stop if it starts decelerating at this branching point, the first row of the trellis always contains the first branching point which the car will reach. Similarly, the last row of the trellis corresponds to the floor where the last waiting passenger is to be picked up. This arrangement of rows spans the solution space which the dynamic programming method has to consider, because the last moment which has to be considered is always the moment the last waiting passenger is picked up. After that moment, the residual cost of passengers assigned to the current car becomes zero.

The total cost $C_{ij}$ incurred on a segment can be expressed simply as the product of the number of waiting passengers, and the duration of the segment.

Transition Probabilities

The last remaining component of the embedded Markov chain are the transition probabilities $P_{ij}$ of transitioning between each pair of states, that is a transition from the current state $S_i$ to one of the many possible future states $S_j$. A large number of these transitions are deterministic and are always taken with probability one. Such are the transitions due to servicing the new and the waiting passengers. For example, the initial trajectory of the car from floor 13 to floor 11 is deterministic. The empty car accelerates until it reaches the branching point for stopping at floor 11 and stops at that floor in order to pick up the first waiting passenger there. After that, the car accelerates again until it reaches the branching floor for stopping at floor 10. From that point on it can take many different paths (states) depending on the unknown destination of the riding passenger.

At the branching point of floor 10, the riding passenger might get off at one of the next 10 floors, and hence the probability that this would be exactly floor 10 is 0.1. With probability 0.9, the riding passenger does not get off at floor 10, and the car continues accelerating until the branching point for floor 9, with there still is one riding passenger, as reflected in FIG. 3.

In the general case, when the car has k floors to go with n riding passengers, and we assume that a riding passenger gets off at any of the k floors with equal probability (1/k), we can find the probability that x riding passengers would want to get off at the next floor by using the formula for a binomial probability function:

$$Pr(x, n, k) = \frac{n!}{(n-x)!x!}\frac{(k-1)^{n-x}}{k^n}. \quad (1)$$

Therefore, n−x riding passengers remain on board the car with a probability Pr(x, n, k). The number of remaining riding passengers n−x specifies which state within a group the Markov chain enters with the probability Pr(x, n, k). However, we still have to find which group, i.e., velocity setting, this state would be in. This velocity setting can be determined by inspecting the existing car and hall calls, as well as the number x of riding passengers exiting the car.

If x>0, or there is a mandatory stop at the next floor due to a car or hall call, then the velocity v at the next state is zero. Only when x=0, i.e., no riding passengers exit the car at the next floor, and there are no car or hall calls for this floor, the car accelerates or maintains maximum velocity.

Determining the Size of the Trellis

The first step in building the Markov chain is to determine the size of the trellis which supports the chain. As noted, the first row of the trellis always contains the first floor at which the elevator could stop in its current direction of motion. The last row of the trellis always contains the last floor in its current direction of motion at which the last waiting passenger is to be picked up, assuming there are no other waiting passengers beyond that floor.

The ordering of the rows in the trellis follows the direction of the car if it continues in its current direction of motion. Potentially, the car can reverse its direction of motion twice during its trip. However, in many cases, the trellis can be pruned long before the car has completed its trip. The maximal number of rows $2N_j$ is reached only if the last waiting passenger is waiting at a floor just passed by the car.

In many cases, for example the one shown in FIG. 3, the car does not have to reverse its direction, even once, in order to pick up all waiting passengers. The number of rows H in the trellis is equal to the effective horizon of the controller measured in floors.

The maximal width of the trellis, i.e., the number of columns M, is determined by inspecting the total number of waiting passengers in either direction. If $N_h$ is the larger of the total number of passengers due to up and down hall calls, then the maximum number of states in a group is $N_h+1$, because there can be no more than $N_h$ riding passengers at the same time. As noted above, we assume that $N_h$ is not bounded by the physical capacity of the car.

After the maximum number of riding passengers $N_h$ has been determined, the width of the trellis can be determined by $M=N_v(N_h+1)$.

Defining the Current State

The next step in building the Markov chain is to define the current state 110 of the chain (system), which is always known precisely. There is no uncertainty in the current state of the chain. If the method according to the invention is implemented in a low-level controller, which regulates the velocity and position of each car, then the controller can always measure the current position and velocity of the car. Thus, the exact location of the car on the phase-space diagram and the next branching point the car encounters can be defined.

If the method is implemented in a discrete-event simulator, then the simulator typically cannot provide the position and velocity of the car at arbitrary moments in time. Therefore, this manner of defining the current state is not applicable. Nevertheless, the next branching point of the car is normally a significant discrete event that has an entry in the priority queue of the simulator. If this is the case, then inspection of the pending events provides the velocity at the next branching point for the current car, denoted by $v_1$. Note that $v_1>0$ only if the car is currently accelerating or running at full velocity. If the car is decelerating or already stopped, then $v_1=0$.

When the future direction of the car is not known, i.e., the car is stopped and empty, the direction of motion upon receiving the hall call is defined by comparing the current floor of the car with the floor of the new hall call.

The initial number of riding passengers pi is defined by considering the velocity $v_1$ at the first branching point and the existing car and hall calls. If the velocity is not zero, then $p_1=0$, because the car cannot pick any new passengers without first stopping. If $v_1=0$, i.e., the car is stopped or decelerating to a stop, then $p_1$ is set to the number of waiting passengers at the stop. If the floor where the car stops next for the current direction of motion does not have a hall call, then $p_1-0$; otherwise, $p_1$ is set to the number passengers that are waiting there.

Hence, the current state of the system is defined by the number of waiting passengers with assigned cars, the direction of travel of the cars, and velocity of the car.

Constructing the Trellis

After the current state of the Markov chain has been found, the entire chain can be constructed by propagating the set of all possible states which can be visited by the car from the current state. The selected organization of the states into a dynamic programming trellis provides a convenient order for doing this.

By inspecting the order of transitions in FIG. 3, it can be seen that if a transition is between different rows, then the starting state is always in a row above the successor state. If a transition is within the same row, then the current state is always to the right of the successor state. This suggests a process for building the Markov chain as shown in lines 1–44 of FIG. 4.

In FIG. 4, the value S[i, v, p] denotes a the state of the trellis in row i, v corresponds to velocity (group), p the number of riding passengers, the value h[i] denotes the number of waiting passengers at that floor corresponding to row i of the trellis, g[i] denotes the floors left to go until the end of the shaft in the current direction, and c[i] denotes the total number of waiting passengers at or after that floor, corresponding to row i of the trellis.

Furthermore, P[i, v, p, i', v', p'] denotes the probability for transitioning to a next state S[i', v', p'] when starting in the current state S[i, v, p], and C[i, v, p, i', v', p'] denotes the total cost for that transition. We also assume that the dynamical model of the motion of the car can be used to determine the transition time T[i, v, p, i', v', p'] between states S[i, v, p ] and S[i', v', p'].

Note that this process can accommodate an arbitrarily complex dependency of T[i, v, p, i', v', p'] on the variables i, v, p, i', v', p', including cases when the motion of the car slows down when there are a lot of passengers inside the car. We also assume that T[i, v, p, i', v', p'] includes the appropriate times for passengers to exit or enter the car, as well as the time for closing and opening doors, when one of the states S[i, v, p ] or S[ i', v', p'] has zero velocity and there are passengers to be picked up or dropped off.

Our method makes use of a flag (flag) which marks a state as possible to visit by the car. Line 1 marks only the current state as possible, and as new transitions are introduced, their successor states are marked as possible also, and processed by the method when it considers them. Line 21 detects the cases when the car is moving and will make a stop. This happens either when a riding passenger wants to get off, there is a scheduled car or hall call, the car has reached the last floor, or there is nobody in the car and the car can reverse its direction of motion at the current floor. The last case (canreverse[i]=TRUE) arises when there are no more hall or car calls in the current direction of motion and there are no hall calls in the opposite direction prior to reaching the current floor.

Note that even if a car can reverse in such situations, the car reverses only if there are no riding passengers in that car. In the case when the car can reverse, there are no riding passengers, the car has stopped, see line 7, then the next possible state is not in the immediately following row of the trellis. Instead, the next possible state is obtained from the array rev[i], see line 8, which contains the precomputed rows of the trellis corresponding to the same floor in the opposite direction to the floor and direction represented by row i.

The method can be implemented by means of various data structures stored in a memory. One embodiment uses an array of linked lists of states, one per row of the trellis, which includes only those states that can actually be visited. Each state in the linked list has another linked list of transitions to other next states that can be reached. Each such transition records information about its probability and cost, and points to the next state.

In an alternative embodiment, an array of M states is preallocated for each row of the trellis. The states that are not marked as possible are simply skipped. This data structure results in faster operation than the one which uses linked lists for the rows of the trellis.

It should be noted that trellis construction and evaluation time can be significantly reduced by skipping highly improbable states. In effect, highly improbable states are treated as impossible states. One way to do this is to simply neglect to add a transition for any disembarkation event whose probability of equation (1) lies below some threshold, e.g., all riding passengers disembarking at the same mid-building floor. However, as the number of passengers in the system increases, nearly all disembarkation events have probability values close to zero. It is important to evaluate a sample of such cases representing the majority of the probability mass in equation (1). This is done very efficiently by adding transitions for states in order of descending probability, stopping when some large fraction of the probability is accounted for, say 99%.

In terms of FIG. 4, the loop on line 20 is reordered so that Pr(x, p, g[i]) in line 36 is descending, and the loop terminates early when the sum over Pr exceeds a chosen fraction. If that fraction is substantially less than one, then the probabilities P[ . . . ] are rescaled to sum to one.

Evaluation of Cost

After the trellis is built, it is used to evaluate the expected costs of all of the possible future states for each car. In contrast to the procedure for constructing the trellis, the procedure for evaluating starts from the bottom row of the trellis proceeding upwards, and processes the states in each row from left to right.

The method iteratively determines the costs, e.g., the expected remaining waiting time, of all of the possible future states in the trellis that can be visited by the car. After the costs are determined for each state, the total cost can be determined for each car.

Determine Expected Cost

FIG. 5 shows the procedure for evaluating the expected cost, e.g., "costtogo." In order to find the total expected cost, the result returned by this procedure is increased by the cost for the car to reach the first branching point, multiplied by the total number of waiting passengers.

Partially Observable System State

Our method assumes that the states of the system are completely observable, including the number of car and hall calls, and the number of waiting passengers per hall call. While knowing the exact number of hall and car calls is always possible, the exact number of waiting passengers per hall call is not readily available. For example, a new passenger may not signal another hall call if there are already other passengers at the floor waiting to travel in the same direction. Or, a group of new passengers arriving at the same time at the same floor may only signal a single hall call. Or, an impatient passenger may signal multiple hall calls. In addition, passengers can get off at any floor after boarding, and waiting passengers can not board a selected car, or board some other car.

There are two types of solutions for dealing with this problem. One of these solutions relies on technical devices, and the other relies on statistical estimation techniques. The simplest technical solution is to require each passengers to press individually a button in the desired direction, even when the button has already been pressed by a previous passenger. This would provide an accurate count of the number of waiting passengers.

Another technique measures the exact number of people waiting on a given floor using a computer vision system. The computer vision system detects and counts people in the space in front of the elevator bank. Such a solution is within the current state of the art in computer vision.

A statistical solution, estimates the expected number of arrivals which must have occurred at a floor after the hall button on that floor was first pressed. If the time elapsed since then is $\Delta t$, and the times between arrivals at this floor are i.i.d. exponentially distributed random variables with arrival rate $\lambda$, then the total number of new passengers comes from a Poisson distribution, whose mean is $\lambda\Delta t$ . Hence, the expected number of passengers at this floor is $\lambda\Delta t+1$ .

Such estimates have been widely used by supervisory control methods with minimal decrease in performance, see, e.g., Bao et al. and Crites et al., cited above.

In order to apply the statistical estimation method, however, the arrival rates at each floor need to be estimated. These arrival rates can come either from on-line statistical estimates of the latest arrivals, or from known traffic profiles accumulated off-line from past data.

It is also possible to combine the computer-vision and statistical estimation. In such a way, the information supplied by the computer-vision system updates the prior probability of the number of waiting passengers, instead of overriding it. The relative influence of each of the two estimates can be controlled by means of the effective sample sizes of the prior distribution.

Non-Uniform Destination Probabilities

The assumption of a uniform probability distribution on passenger destinations will certainly be violated for most real buildings, which usually have different number of occupants on each floor, so the traffic flow from the lobby to different floors cannot be assumed to be uniform. Furthermore, traffic between floors other than the lobby is usually non-uniform. For example, in the case when a single company is occupying multiple adjacent floors in a building and there is a lot of traffic between these related floors, but little or no traffic to and from other, unrelated floors.

Extending the method to non-uniform trip probabilities is straightforward if the rates $\lambda_{ij}$ of trips from floor i to floor j are known, as described above. The extension to the method involves two changes. One in the states of the embedded Markov chain, and another in the formula for the transition probabilities between these states.

In order to understand the change in state space, the elevator car can be thought of as having $N_f$ smaller (virtual) compartments, one for each floor of the building. Passengers boarding the car at a particular floor enter the corresponding compartment, and the state in the modified Markov chain keeps track of how many passengers are in each compartment. To this end, each group of states, corresponding to the NV individual velocities, is further subdivided into subgroups corresponding to each compartment. In practice, subgroups are maintained only for those floors with an assigned hall call. If the number of such floors is $N_w$, then, the total number of states in a group is $N_h+N_w$, as opposed to $N_h+1$ in the basic method. Such a change does not affect the complexity of the method.

The second change is in the transition probabilities between pairs of states. Instead of using a single binomial formula, these probabilities have to be determined individually for each car. If n is the number of remaining riding passengers in car i, i.e., boarded on floor i, j is the next floor, and $\lambda_j$ is the sum of $\lambda_{ik}$, such that k ranges from j to the end of the building in the current direction of motion of the car, then the probability that x of the n riding passengers in car i will exit the car at floor j comes from a binomial distribution with parameters x, n, and $\lambda_{ij}/\lambda_j$. Note that it is not necessary to keep track of how many riding passengers exited. This is taken care of by repeated renormalization of the parameter $\lambda_j$, which indirectly controls the binomial distribution. This second change does not affect the complexity of the method either.

If this solution is implemented, then our method is applicable to all possible traffic patterns, ranging from purely up-peak to purely down-peak traffic and covering all intermediate cases such as lunch traffic.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for controlling an elevator system having a plurality of cars, comprising:

determining, for each car, a set of all possible future states of the elevator system for the car to service a hall call;

evaluating a cost function to determine a cost for each set of all possible future states; and assigning a particular car associated with the set having a least cost to service the hall call.

2. The method of claim 1 wherein all possible future states of each car depend on a current state of the elevator system, and further comprising:

defining the current state of the elevator system by passengers having assigned cars, and for each car a direction of travel, a position, and a velocity of the car.

3. The method of claim 2 wherein the direction is a discrete variable, and the position and the velocity are continuous variables, and further comprising:

discretizing each continuous variable to a range of discrete variables.

4. The method of claim 1 wherein the elevator system includes a plurality of floors, further comprising:

constraining the determining by known destinations of passengers riding to the plurality of floors on assigned cars.

5. The method of claim 2 wherein the determining further comprises:

organizing each set of all possible future states in a corresponding dynamic programming trellis.

6. The method of claim 5 further comprising:

associating each state in the trellis with a transition probability.

7. The method of claim 6 further comprising:

excluding highly improbable future states from the set all possible future states.

8. The method of claim 7 wherein the highly improbable future states have associated transition probabilities less than a predetermined threshold.

9. The method of claim 7 wherein the highly improbable future states are a subset of the set of possible future states, the subset having smallest transition probabilities and the sum of the smallest transition probabilities is less than some predetermined value.

10. The method of claim 1 further comprising:

associating a waiting time with the cost for each set of all possible future states.

11. The method of claim 1 wherein the cost for each set of all possible future states of the elevator system for car i to service the hall call is $$C_i = C_i^+ + \sum_{j=1, i\neq j}^{N_c} C_j^-,$$

for i=1, . . . , $N_c$, where $N_c$ is a total number of cars, $C_i^-$,i=1,$N_c$ is an expected cost for servicing a set of waiting passengers assigned to car i, and $C_i^+$,i=1,$N_c$ is an expected cost for servicing both the set of waiting passengers and the hall call.

12. The method of claim 11 further comprising:

minimizing a total residual cost $c=\text{argmin}_i C_i$ for each set of all possible future states to service the hall call to determine the least cost.

13. The method of claim 5 wherein the cost for each set of all possible future states is associated with a path through the trellis, including a finite number of segments, and further comprising:

determining a transition cost for each segment in the path; and applying the transition cost for each segment to any paths which include that segment.

14. The method of claim 5 wherein a state $S_i$ in the trellis for a particular car is described by a four-tuple (f,d,v,n), where f is the position of the car, d is the direction, v is the velocity, and n is a number of passengers inside the car.

15. An apparatus for controlling an elevator system having a plurality of cars, comprising:

means for determining, for each car, a set of all possible future states of the elevator system for the car to service a hall call;

means for evaluating a cost function to determine a cost for each set of all possible future states; and means for assigning a particular car associated with the set having a least cost to service the hall call.

16. A method for controlling an elevator system having a plurality of cars, comprising:

determining, for each car, a set of all possible future states of the elevator system if the car is to service a hall call;

evaluating a cost function to determine a cost for each set of all possible future states, in which the cost for each set of all possible future states of the elevator system for car i to service the hall call is $$C_i = C_i^+ + \sum_{j=1, i \neq j}^{N_c} C_j^-,$$

for $i=1, \ldots, N_c$, where $N_c$ is a total number of cars, $C_i^-, i=1,N_c$ is an expected cost for servicing a set of waiting passengers assigned to car i, and $C_i^+, i=1,N_c$ is an expected cost for servicing both the set of waiting passengers and the hall call; and assigning a particular car associated with the set having a least cost to service the hall call.

* * * * *